United States Patent [19]

Kawano

[11] 3,988,174

[45] Oct. 26, 1976

[54] HOT ROLLED STEEL SHEET HAVING EXCELLENT WORKABILITY AND METHOD THEREOF

[75] Inventor: Tsuyoshi Kawano, Kisaragu, Japan

[73] Assignee: Nippon Steel Corporation, Tokyo, Japan

[22] Filed: July 11, 1975

[21] Appl. No.: 595,092

Related U.S. Application Data

[63] Continuation-in-part of Ser. No. 499,923, Aug. 23, 1974, abandoned, which is a continuation of Ser. No. 345,691, March 28, 1973, abandoned.

[30] Foreign Application Priority Data

| | | |
|---|---|---|
| Apr. 3, 1972 | Japan | 47-32563 |
| Apr. 3, 1972 | Japan | 47-32564 |
| Sept. 20, 1972 | Japan | 47-93685 |

[52] U.S. Cl. ..... 148/12 C; 148/36

[51] Int. Cl.[2] ..... C21D 9/48

[58] Field of Search ..... 148/12 C, 36

[56] References Cited

UNITED STATES PATENTS

| | | | |
|---|---|---|---|
| 2,772,154 | 11/1956 | Morgan et al. | 75/123 B |
| 3,666,452 | 5/1972 | Korchynsky et al. | 148/12 F |
| 3,725,143 | 4/1973 | Alworth et al. | 148/36 |
| 3,765,874 | 10/1973 | Elias et al. | 148/12 C |
| 3,798,076 | 3/1974 | Shimizu et al. | 148/12 C |
| 3,821,031 | 6/1974 | Kubotera et al. | 148/12 C |
| 3,839,095 | 10/1974 | Kubotera et al. | 148/12 C |
| 3,897,280 | 7/1975 | Gondo et al. | 148/12 C |

*Primary Examiner*—W. Stallard

*Attorney, Agent, or Firm*—Toren, McGeady and Stanger

[57] ABSTRACT

A hot rolled steel sheet having excellent cold workability comprising not more than 0.10% of carbon, not more than 0.10% of silicon, not more than 0.50% of manganese, not more than 0.0080% of nitrogen, 0.003-not more than 0.080% of acid-soluble aluminum, 0.0020 – 0.0050% of boron, the balance being iron and unavoidable impurities.

10 Claims, No Drawings

HOT ROLLED STEEL SHEET HAVING EXCELLENT WORKABILITY AND METHOD THEREOF

REFERENCE TO RELATED APPLICATIONS

This application is a Continuation-in-Part of Ser. No. 499,923, filed on Aug. 23, 1974, and now abandoned, the contents of which are incorporated herein by reference, which, in turn, is a continuation of application Ser. No. 345,691 filed on Mar. 28, 1973, and now abandoned.

BACKGROUND OF THE INVENTION

1. Field of the Invention

The present invention relates to an Al-killed hot rolled steel sheet having excellent workability and a production method thereof. More particularly the present invention relates to an Al-killed hot rolled steel sheet containing boron and a method for producing a hot rolled steel sheet having excellent cold workabilities.

2. Description of the Prior Art

Conventionally, an Al-killed hot rolled steel sheet has been widely used as a deep-drawing hot rolled steel sheet. However, the Al-killed hot rolled steel sheet has a defect in that it has higher yield point and it is harder as compared with a rimmed steel and a capped steel. For overcoming this defect, it has been proposed to apply a high coiling temperature (for example 700°–720° C) so as to soften the steel and improve the cold workability. Even in this case, as the high coiling temperature is required, the acid pickling efficiency is lowered so that the productivity is greatly lowered, or the high coiling temperature causes the coalescence and coarsening of carbides so that the improvement of the cold workability is partly hindered.

SUMMARY OF THE INVENTION

One of the objects of the present invention is to provide a novel hot rolled steel sheet, which has overcome completely the above defects of the conventional Al-killed hot rolled steel sheet.

One of the objects of the present invention is to provide a hot rolled steel sheet which is softer than the conventional Al-killed hot rolled steel sheet, and which possesses excellent cold workability and ageing-resistance.

Another object of the present invention is to provide a hot rolled steel sheet having excellent cold workability, and ageing resistance as well as good acid-pickling properties.

Still another object of the present invention is to provide a hot rolled steel sheet having excellent cold workability particularly remarkably improved hole expanding workability.

The features of the present invention reside firstly in an Al-killed hot rolled steel sheet comprising not more than 0.10% of carbon, not more than 0.10% of silicon, not more than 0.50% of manganese, 0.003 to not more than 0.080% of acid soluble aluminum, 0.0020 – 0.0050% of boron, not more than 0.008% of nitrogen, with the balance being iron and unavoidable impurities; and secondly in an Al-killed hot rolled steel sheet comprising C < 0.01%, Si ≦ 0.10%, Mn ≦ 0.50%, sol. Al ≦ 0.080%, B = 0.0020–0.0050% with the balance being iron and unavoidable impurities.

The Al-killed steel containing a very small amount of B according to the present invention may contain one or more elements selected from group A consisting of Zr, Ca, Mg and REM and also may contain one or more elements selected from group B consisting of Ti, Cr, V, Nb, Mo and W. The above minor elements may be contained in the following ranges.

One or more of the A group: 0.01 to 0.20% in total (the amounts of Ca, Mg and REM are amounts added to the molten steel)

One or more of the B group : 0.01 to 0.10% in total

DESCRIPTION OF THE PREFERRED EMBODIMENT

It has been known that boron fixes nitrogen in the steel to make the steel non-ageing. In the hot rolled steel sheet, conventionally more than 0.007% of boron has been added to the steel for making the steel non-ageing. However, the present invention have found that when boron is added to an Al-killed steel, not only is the nitrogen in the steel fixed as BN by the very small addition of boron even when a low temperature coiling (a coiling temperature below about 680° C herein designated as a low coiling temperature) is conducted after the hot rolling, but also, the boron promotes the AlN precipitation so that the aluminum addition may be smaller than when aluminum is added alone.

In the case of an Al-killed steel containing no boron, for example, a 0.04% Al- 0.0050% N steel, the steel is not non-ageing unless the coiling is done above 700° C, while in the case of a 0.03% Al-0.0030% B - 0.0055% N steel the steel is made non-ageing even by coiling at 600° C. When aluminum is added alone, more than 0.10% of acid soluble aluminum is required in order to make the steel non-ageing by the coiling at 600° C. It is understood from this fact that the aluminum and boron contents can be remarkably lowered as compared with the conventional compositions. Therefore, the production cost is lower and the surface appearance is better than those obtained by the conventional method. Also, when aluminum and boron are added in combination, a high coiling temperature is not necessary so that the coarse coalescent cementite harmful for applications where local deformation ability, such as, local stretching is required is not formed, and the carbides are finely dispersed and good acid-pickling efficiency is obtained.

Further, a feature of a boron containing steel is that the ferrite grains after the hot rolling are enlarged. In the case of aluminum addition alone, the ferrite grain size is only 9 – 9.5 by ASTM grain size number even when a high coiling temperature above 700° C (a coiling temperature above about 680° C is herein designated a high coiling temperature) is applied, while the ferrite grain size of the present inventive steel containing boron is as large as 8 – 8.5 by ASTM grain size number with a low coiling temperature at about 600° C and thus a low yield point, excellent ductility and deep-drawability can be obtained as compared with the case of the conventional steel. According to the present invention, a hot rolled steel sheet having a grain size number not larger than No. 9 is consistently obtained.

As one of the remarkable features obtained by the present invention, the small addition of B remarkably improves the brittle fracture sensitivity after deep-drawing. In general, when C is lowered, the cold workability is improved, but the brittle fracture sensitivity is deteriorated.

Therefore, the conventional extremely low-carbon steel is very susceptible to the brittle fracture after press working, although it can stand up to strong deep-drawing, and for this reason it has been practically impossible to apply a strong cold working.

However, when a very small amount of B is added to the steel, the brittle fracture sensitivity can be remarkably improved and thus it is possible to attain a maximum degree of cold workability through the combination of the extreme low carbon content ($C < 0.010\%$) with the addition of a very small amount of B.

The reasons for limitations of individual elements in the steel composition to be used in the present invention is described hereinbelow.

Although carbon increases the steel strength, but lowers remarkably the cold workability of hot rolled steel sheet and thus its upper limit is set at 0.10%. Particularly, when a steel sheet which is soft and has excellent cold workability is required, it is desirable to restrict the carbon content to 0.06% or less.

Further, when the carbon content is reduced less than 0.010% by vacuum degassing etc., the cold workability is further improved. On the other hand, however, when the carbon is reduced to 0.01% or less, the brittle fracture sensitivity after deep-drawing is deteriorated in contrast to the improvement of the cold workability. However, in the case of steels containing B, according to the present invention, the brittle fracture sensitivity is very excellent. This is considered to be due to the fact that the inter-granular embrittlement due to the lowered C content is prevented by B. Therefore, according to the present invention, it is possible to produce a steel sheet having the highest degree of cold workability by the combination of the extremely low carbon content ($C < 0.010\%$) and the very small amount of B. Of course, the above effect of B is maintained when the carbon content is 0.010% or more, and more remarkable particularly when a low-temperature coiling of not higher than 680° c is performed.

As silicon hardens the steel and lowers the cold workability, it is desirable not to add silicon where strength is not required, but the silicon content up to 0.10% does not lower the cold workability substantially and thus the upper limit is set at 0.10%.

However, the preferably range of Si is not more than 0.02% which is unavoidable, because Si has the tendency to increase the amount of silicate inclusions which are elongated by the hot rolling and lower the cold workabilities. That is to say, Si is often present at unavoidable impurity levels, i.e., up to about 0.02%, and its presence up to this level is difficult, if not impossible to circumvent. When Si is added in an amount not less than 0.03% thus enhancing the strength, it is desirable to add more than 0.015% sol.Al in order to prevent formation of the silicate inclusions harmful to the workability.

Manganese is necessary for preventing the redshortness due to sulphur, but hardens the steel and lowers the cold workability and thus its upper limit is set at 0.50%. But it is desirable to restrict the manganese content below 0.35% where strength is not specifically required, and with a manganese content less than 0.25%, the steel possesses improved cold workability.

Particularly when the C content is less than 0.010%, the hole expanding workability is improved through the combination of the softening effect and the shape control of the inclusions if the Mn is not higher than 0.25%.

Aluminum is required to be present as acid soluble Al in an amount of at least 0.003% and more for assuring the effect of the boron and killing the steel. Thus, the acid soluble aluminum is present in the steel in an amount effective completely to kill the steel. Preferably the amount of sol.Al is more than 0.015% in order to prevent the formation of silicate inclusions harmful to the workability. But with an acid soluble aluminum content of more than 0.08%, not only is the effect of Al saturated, but also, the cleanness of the steel is deteriorated and further the ferrite grains are made finer and become nearly the same as Al-killed steel. Thus the upper limit is limited to 0.08%. However it is desirable to restrict the acid soluble aluminum content to less than 0.06% when better results are desired.

In the case of a hot rolled steel sheet, a very small amount of boron not only fixes the nitrogen in the steel as BN, but also promotes the precipitation of AlN even when the high coiling temperature is not applied after the hot rolling, so that the steel can be made non-ageing by a smaller amount of Al and B than conventional steels. Thus, in the present steel, the nitrogen is fixed as AlN and BN. Further boron addition enlarges the ferrite grains after the rolling without the high coiling temperature and better softness and better cold workability than possessed by conventional steels can be obtained.

Also, as mentioned before, B remarkably improves the brittle fracture sensitivity after deep-drawing, and this effect is still more remarkable when $C < 0.010\%$.

Still further, in the present inventive steel containing boron, as the low coiling temperature can be used, it is possible to produce a hot rolled steel sheet containing no coalescent and coarse cementite harmful for applications which require local deformation ability, such as, local stretching. However, with less than 0.002% of boron, the above effects are not obtained and with more than 0.005% of boron, not only are its effects saturated, but also, the cleanness of the steel is poor. Thus the upper limit of boron is limited to 0.005%.

Normally, nitrogen is contained in an amount between 0.002 and 0.008% in an Al-killed steel, but it increases the ageing property and is harmful to the cold workability, and further, an increased amount of nitrogen increases the amount of Al and B required for non-ageing, and as a result lowers the cold workability. Thus its upper limit is set at 0.008%.

The contents of aluminum and boron have been explained before, but it is desirable that the minimum total amount of (Al + B) is $2.7 \times (N\%)$ or more in order to fully develop the advantages of the present invention. As the total amount of (Al + B) increases, the ferrite grains become finer, and when the total amount exceeds $20 \times (N\%)$, the aluminum content also increases, and thus the resultant properties of the steel are almost same as those of steel to which only aluminum has been added. Thus it is desirable to limit the total amoount of aluminum and boron besides the limitations of each of Al and B as follows:

$$(Al + B) \leqq 20 \times [N\%]$$

In order to develop the advantages of the present invention it is more desirable to limit this total amount as follows:

$$(Al + B) \leqq 15 \times [N\%]$$

In order to attain the desired results of the present invention, it is better to restrict the B content as low as possible and it is desirable to maintain the ratio B/N to less than 1.0.

As for S which is one of the unavoidable impurities, it is not specifically limited in the present invention, but it is desired to maintain it as low as possible and particularly in the case where C is less than 0.010% and Mn is not higher than 0.25%, the cold workability, particularly the hole expanding workability, is remarkably enhanced through the softening effect and the control of shape and the amount of the sulfide inclusions, if S is less than 0.01%.

Further, the following facts have been found for improving the hole expanding workability. When the C content is maintained less than 0.01% and one or more of Ti, Cr, V, Nb, Mo and W is added, the carbides are dispersed more finely and the hole expanding workability is improved. In this case, a small carbon content exerts a more enhanced effect, and carbon contents of not less than 0.010% are not effective. In this case, improvement of the hole expanding workability is attained when one or more of Ti, Cr, V, Nb, Mo and W is added in an amount not less than 0.01% either alone or in total, but if it exceeds 0.10%, the steel is hardened, and thus only an adverse effect is caused.

Next, when one or more of Zr, Ca, Mg and REM elements is added the elongated sulfide inclusions are spheroidized to still further improve the hole expanding workability. In this case also, the tendency is that a lower carbon content exerts a more remarkable effect. When one or more of Zr, Ca, Mg, and REM elements is added in an amount not lower than 0.01% (amount as actually added) in single or in total, the hole expanding workability is improved. But, on the other hand, when the addition exceeds 0.20%, coarse inclusions are formed to lower the hole expanding workability.

The steel sheet having the above chemical composition is produced in the following way.

Molten steel prepared by a conventional steel making method is made into slabs by a conventional method. Boron may be added in a ladle or an ingot mold, and in a tundish in the case of continuous casting.

When the steel sheet is used with a metal coating, for example, a galvanized sheet, it is desirable that the steel is made into a core-killed ingot. The slabs are reheated and then hot rolled and coiled on a coiler.

As for the hot rolling condition of the hot rolled steel sheet according to the present invention, it should be that the finishing temperature is above the $Ar_3$ point in view of the cold workability, but when softness rather than cold workability is required, the rolling may be finished at a temperature below the $Ar_3$ point.

Particularly when the C content is less than 0.010%, the $Ar_3$ transformation point is higher and thus a finishing temperature not lower than 910° C is desirable from the points of complete prevention of the grain coarsening in the surface layer and deterioration of the brittle fracture sensitivity after deep-drawings due to this surfacial grain coarsening. Further, when the Mn content is maintained not higher then 0.25% in order to attain a further improvement of the cold workability, the $Ar_3$ transformation point becomes still higher, and thus it is desirable that the finishing temperature is not lower than 910° C and is maintained as high as possible.

In addition to the limitation of the finishing outlet temperature, it has been found that the still better results can be obtained in the present invention when a total rolling reduction not lower than 40%, preferably more than 50% based on the plate thickness at 1150° C, is given to the steel in a temperature range from 1150° to 1050° C. Although the reason for this fact is not fully explained, it is considered that the precipitation during the hot rolling has some connection therewith.

Regarding the coiling temperature, the coiling is done below 680° C to finely disperse the carbides in order to prevent the coalescence and coarsening of the carbides which are harmful to the local deformation ability, such as, local stretching. However where the acid-pickling efficiency and the local deformation ability are not critical and the steel softness are required, the coiling may be done at a high temperature above 680° C, and this case is also within the scope of the present invention.

EXAMPLE 1

The steels having chemical compositions shown in Table 1 were prepared in a converter, and cast into ingots or slabs by continuous casting. The ingots were subjected to a slabbing mill, and the obtained slabs were reheated and hot rolled at a temperature above the $AR_3$ point and coiled. The properties of the hot rolled sheets are shown in Table 2.

Table 1

| | | Chemical Composition (%) | | | | | | Coiling temp. (° C) | Sheet thickness (mm) |
|---|---|---|---|---|---|---|---|---|---|
| | | C | Si | Mn | sol.Al | B | N | | |
| Comparative Steels | A | 0.05 | 0.02 | 0.31 | 0.043 | — | 0.0052 | 720 | 2.3 |
| | B | 0.05 | 0.02 | 0.31 | 0.043 | — | 0.0052 | 620 | 2.3 |
| | C | 0.04 | 0.01 | 0.33 | 0.105 | — | 0.0065 | 640 | 2.3 |
| Inventive Steels | D | 0.04 | 0.01 | 0.32 | 0.030 | 0.0035 | 0.0057 | 600 | 2.3 |
| | E | 0.05 | 0.02 | 0.29 | 0.045 | 0.0028 | 0.0058 | 615 | 3.2 |
| | F | 0.05 | 0.02 | 0.29 | 0.045 | 0.0028 | 0.0058 | 660 | 3.2 |
| | G | 0.06 | 0.01 | 0.33 | 0.028 | 0.0037 | 0.0050 | 600 | 2.7 |
| | H | 0.03 | 0.01 | 0.34 | 0.043 | 0.0029 | 0.0056 | 615 | 2.3 |
| | I | 0.04 | 0.01 | 0.31 | 0.058 | 0.0036 | 0.0062 | 620 | 2.3 |
| | J | 0.04 | 0.01 | 0.32 | 0.037 | 0.0030 | 0.0055 | 720 | 2.5 |
| | K | 0.008 | 0.02 | 0.21 | 0.021 | 0.0031 | 0.0048 | 650 | 2.7 |

Table 2

| | | Tensile Properites (JIS No. 5) | | | | | |
|---|---|---|---|---|---|---|---|
| | | Yield Point ($Kg/mm^2$) | Tensile Strength ($Kg/mm^2$) | Elongation (%) | Ageing* Index ($Kg/mm^2$) | Grain size (ASTM No.) | Forms of carbides |
| Comparative Steels | A | 22.8 | 34.4 | 45.5 | 0.6 | 9.4 | coalescent and coarse |

Table 2-continued

| | | Tensile Properites (JIS No. 5) Yield Point (Kg/mm²) | Tensile Strength (Kg/mm²) | Elongation (%) | Ageing* Index (Kg/mm²) | Grain size (ASTM No.) | Forms of carbides |
|---|---|---|---|---|---|---|---|
| | B | 25.7 | 37.7 | 42.5 | 5.5 | 9.6 | finely dispersed |
| | C | 24.6 | 36.1 | 46.5 | 0.7 | 9.7 | " |
| Inventive Steels | D | 20.1 | 33.2 | 47.7 | 0 | 8.3 | " |
| | E | 20.6 | 32.4 | 49.5 | 0 | 8.5 | " |
| | F | 19.8 | 31.8 | 47.8 | 0 | 8.0 | " |
| | G | 21.5 | 33.7 | 48.4 | 0 | 8.2 | " |
| | H | 20.4 | 32.9 | 48.7 | 0 | 8.5 | " |
| | I | 22.5 | 33.2 | 48.1 | 0 | 8.7 | " |
| | J | 19.2 | 30.8 | 46.5 | 0.6 | 8.0 | coalescent and coarse |
| | K | 18.7 | 30.3 | 50.4 | 0 | 7.5 | |

*Increase of yield point after pre-tensile strain of 8% and 100° C × 1 hr. artificial ageing.

As understood from Table 2, a high temperature coiling is required for making the steel non-ageing and soft in the case of the aluminum alone addition, while when a very small amount of boron is added, it is possible to reduce the aluminum content and to apply a low coiling temperature, and thus it is possible to obtain a hot rolled steel sheet in which no coarse and coalescent cementite which is harmful to the cold workability is present. Naturally, when the acid pickling efficiency or the coarse and coalescent cementite is not a problem, the steel can be made softer by applying a high coiling temperature and yet the steel has a similar or better cold workabiity than the comparative steels. The steel K whose carbon content has been reduced to less than 0.010% by vacuum degassing shows very excellent cold workability.

The grain size number of the steels according to the present invention is always not larger than No. 9.

EXAMPLE 2

The steels ($A_1$ to $A_{10}$) were prepared in a converter, vacuum-degassed according to the present invention and made into slabs by an ordinary method. These steel slabs ($A_1$ to $A_{10}$) and the present inventive normal C steel slabs ($A_{11}$ to $A_{13}$) were heated at 1250° C, hot rolled and coiled to obtain hot rolled steel sheets of a final thickness of 3.2mm. The comparative steels ($B_1$ to $B_2$) were obtained in the same manner.

Table 3 shows the chemical compositions of the hot rolled steel sheets, conditions of hot rolling, steel cleanness, ratio of longitudinal-cross length of sulfide inclusions. mechanical properties, punched hole expansion properties, conical cup test valves and limit drawing ratios of secondary workability (brittle fracture sensitivity after deep-drawing) tests.

The ratio of longitudinal-cross length of the inclusions means a value obtained by dividing the maximum length of the inclusions in the rolling direction by the maximum width of the inclusions in the direction perpendicular to the rolling direction, and is usually expressed by an average value of inclusions within several ten view fields, but in this example it is expressed by an average in 20 view fields with a 500× photomicroscope.

The punched hole expansion properties are obtained by the formula:

The punched hole expansion ratio % =

$$\frac{d - do}{do} \times 100$$

in which do (mm) is the diameter of a hole punched in a steel sheet and d (mm) is a diameter of the hole when a visible crack is caused around the hole during expansion of the hole by a conical punch.

Estimations of the secondary workability (brittle fracture sensitivity after deep drawing) of the steel sheet will be described briefly hereunder.

A disc blank is taken from a steel sheet and a primary drawing is done by a one-step or multi-step drawing, and then the wall portion of the drawn work piece is given a large circumferential stress to see whether there is caused a brittle crack at the wall portion, and the maximum drawing ratio of the primary working which does not cause the brittle crack is called as the limit drawing ratio in the secondary workability test. A larger value of this ratio represents a better secondary workability.

Also as for estimation of the ageing property, the results of measurements of restoration of yield point elongation by artificially ageing a steel sheet as skin-pass rolled at 100° C for 60 minutes are shown in Table 3. A layer value of these measurements represents a worsened ageing property.

As is understood from Table 3, the hot rolled steel sheets of the present invention having a carbon content less than 0.010% reduced by the vacuum degassing treatment are all very excellent in respect to the punched hole expansion properties, the conical cup test value and the secondary workability of the deep-drawn article. Particularly, the steel $A_2$, $A_5$, $A_6$ and $A_{10}$ which contain not higher than 0.25% Mn and not higher than 0.009% S show excellent punched hole expansion properties.

The steels $A_{11}$, $A_{12}$, and $A_{13}$ of the present invention which contain an ordinary carbon content are softer than the comparative steels $B_7$ and $B_{12}$ which contain an almost the same carbon content, and also show excellent secondary workability. These results clearly indicate remarkable effects of the B addition.

The steels outside the scope of the present invention are inferior in the following points.

The steels $B_4$ and $B_{11}$ which are reduced in carbon content to not more than 0.010% by vacuum degassing but do not contain added B or any of the alloying elements of the Group A and Group B show a large ratio of longitudinal-cross length of the sulfide inclusions and poor punched hole expansion properties and a poor conical cup test value. The steels $B_5$, $B_6$ and $B_{10}$ which contain not more than 0.010% carbon and no boron, but contain the alloying elements of the group A or B in an amount beyond the limitation of the present invention, show excessive hardness in spite of a small ratio of longitudinal-cross length of the sulfide inclusions and are inferior in respect to rupture elongation, punched hole expansion properties and the conical cup test value.

Also the steels $B_7$ and $B_{12}$ which were not vacuum-degassed and contain more than 0.010% carbon with no addition of boron, are excessively hard and show remarkably lower rupture elongation, punched hole expansion properties and conical cup test values as compared with the steel sheets of the present invention.

Further, the steels $B_1$, $B_2$, $B_3$, $B_8$ and $B_9$ which were reduced in their carbon content to not more than 0.010% by vacuum degassing and contain the addition elements of the groups A and B in an amount within the limitations of the present invention, but do not contain any added boron, show a low limit drawing ratio in the secondary workability test in spite of their excellent punched hole expansion properties and conical cup test values, and thus can not be subjected to severe deep-drawing.

All of the steels outside the scope of the present invention are inferior to those of the present invention in respect of ageing property.

Meanwhile all of the steels of the present invention have a grain size number not larger than No. 9.

TABLE 3-1

| | | Analysis of Hot Rolled Steel Sheet (wt %) | | | | | | | | | Others | |
|---|---|---|---|---|---|---|---|---|---|---|---|---|
| | | C | Si | Mn | P | S | O | N | sol. Al | B | A Group | B Group |
| | A1 | 0.007 | 0.019 | 0.30 | 0.009 | 0.013 | 0.007 | 0.0064 | 0.041 | 0.0020 | Ca 0.02(*) Mg 0.02(*) | W 0.03 |
| | A2 | 0.005 | 0.018 | 0.24 | 0.010 | 0.008 | 0.008 | 0.0066 | 0.058 | 0.0045 | Zr 0.04 | Nb 0.02 V 0.01 |
| | A3 | 0.009 | 0.019 | 0.28 | 0.011 | 0.014 | 0.006 | 0.0071 | 0.060 | 0.0025 | | Cr 0.04 Ti 0.02 |
| | A4 | 0.008 | 0.018 | 0.32 | 0.010 | 0.012 | 0.007 | 0.0066 | 0.026 | 0.020 | Misch metal 0.04(*) | |
| | A5 | 0.006 | 0.020 | 0.19 | 0.012 | 0.008 | 0.06 | 0.0058 | 0.038 | 0.0028 | Ca 0.02(*) Misch metal 0.02(*) | Mo 0.01 V 0.02 |
| Steels | A6 | 0.008 | 0.017 | 0.25 | 0.012 | 0.009 | 0.008 | 0.0038 | 0.019 | 0.0030 | Zr 0.04 Mg 0.01(*) | W 0.02 |
| of | A7 | 0.006 | 0.020 | 0.28 | 0.010 | 0.011 | 0.008 | 0.0052 | 0.022 | 0.0042 | Zr 0.03 | Cr 0.05 |
| Present | A8 | 0.008 | 0.018 | 0.35 | 0.011 | 0.009 | 0.006 | 0.0070 | 0.054 | 0.0023 | Misch metal 0.06(*) | |
| Invention | A9 | 0.009 | 0.019 | 0.30 | 0.010 | 0.013 | 0.008 | 0.0068 | 0.34 | 0.0026 | | Nb 0.02 Ti 0.02 |
| | A10 | 0.005 | 0.020 | 0.18 | 0.012 | 0.007 | 0.008 | 0.0073 | 0.042 | 0.0021 | Mg 0.02(*) Zr 0.01 | Mo 0.01 W 0.01 |
| | A11 | 0.036 | 0.014 | 0.22 | 0.012 | 0.013 | 0.007 | 0.0058 | 0.031 | 0.0030 | Zr 0.04 | |
| | A12 | 0.042 | 0.016 | 0.25 | 0.013 | 0.012 | 0.007 | 0.0051 | 0.026 | 0.0027 | Misch metal 0.04(*) | |
| | A13 | 0.032 | 0.013 | 0.20 | 0.008 | 0.014 | 0.006 | 0.0062 | 0.043 | 0.0032 | Ca 0.03(*) | |
| | B1 | 0.006 | 0.018 | 0.26 | 0.010 | 0.011 | 0.006 | 0.0071 | 0.036 | | Zr 0.08 | Nb 0.02 Ti 0.02 |
| | B2 | 0.009 | 0.016 | 0.32 | 0.008 | 0.012 | 0.008 | 0.0062 | 0.040 | | Ca 0.03(*) | Cr 0.02 |
| | B3 | 0.008 | 0.020 | 0.24 | 0.011 | 0.012 | 0.008 | 0.0053 | 0.058 | | Misch metal 0.04(*) | W 0.02 |
| | B4 | 0.008 | 0.016 | 0.24 | 0.011 | 0.012 | 0.008 | 0.0064 | 0.043 | | | |
| | B5 | 0.005 | 0.016 | 0.29 | 0.011 | 0.011 | 0.007 | 0.0066 | 0.068 | | Zr 0.30 | Nb 0.14 |
| Comparative | B6 | 0.008 | 0.020 | 0.18 | 0.010 | 0.011 | 0.006 | 0.0058 | 0.032 | | Misch metal 0.06(*) | W 0.06 Cr 0.10 |
| Steels | B7 | 0.032 | 0.013 | 0.20 | 0.008 | 0.014 | 0.008 | 0.0062 | 0.063 | | Ca 0.04(*) | |
| | B8 | 0.008 | 0.026 | 0.28 | 0.010 | 0.014 | 0.008 | 0.0073 | 0.042 | | Ca 0.04(*) | Nb 0.03 |
| | B9 | 0.005 | 0.020 | 0.24 | 0.011 | 0.012 | 0.009 | 0.0058 | 0.103 | | Mg 0.02(*) | V 0.02 Cr 0.03 |
| | B10 | 0.007 | 0.020 | 0.19 | 0.009 | 0.011 | 0.008 | 0.0052 | 0.036 | | Zr 0.24 | Cr 0.08 Mo 0.07 |
| | B11 | 0.005 | 0.28 | 0.24 | 0.010 | 0.013 | 0.006 | 0.0061 | 0.120 | | | |
| | B12 | 0.026 | 0.021 | 0.25 | 0.010 | 0.010 | 0.008 | 0.0050 | 0.086 | | Zr 0.08 | Nb 0.06 |

Remark: (*)Amount actually added

Table 3-2

| | | Hot Rolling Condition (° C) | | Cleannes (%) | | Ferrite Grain Size No. (ASTM) | Ratio of Longitudinal-Cross Length of Sulfide Inclusions |
|---|---|---|---|---|---|---|---|
| | | Finishing Temp. | Coiling Temp. | A type | Total | | |
| | A1 | 920 | 590 | 0.012 | 0.074 | 7.8 | 2 |
| | A2 | 915 | 625 | 0.015 | 0.068 | 8.2 | 3 |
| | A3 | 910 | 615 | 0.019 | 0.081 | 8.0 | 8 |
| | A4 | 910 | 605 | 0.018 | 0.076 | 7.9 | 3 |
| | A5 | 910 | 610 | 0.016 | 0.072 | 8.3 | 2 |
| Steels | A6 | 930 | 600 | 0.012 | 0.066 | 7.9 | 2 |
| of | A7 | 915 | 650 | 0.014 | 0.068 | 8.1 | 3 |
| Present | A8 | 920 | 620 | 0.016 | 0.084 | 8.2 | 2 |
| Invention | A9 | 910 | 585 | 0.012 | 0.071 | 8.0 | 7 |
| | A10 | 920 | 605 | 0.018 | 0.059 | 7.8 | 3 |
| | A11 | 890 | 610 | 0.015 | 0.065 | 8.5 | 3 |
| | A12 | 880 | 600 | 0.018 | 0.052 | 8.4 | 4 |
| | A13 | 895 | 595 | 0.017 | 0.043 | 8.5 | 3 |

Table 3-2-continued

| | | | | | | | |
|---|---|---|---|---|---|---|---|
| Comparative Steels | B1 | 910 | 580 | 0.013 | 0.078 | 8.6 | 3 |
| | B2 | 935 | 620 | 0.010 | 0.082 | 8.6 | 3 |
| | B3 | 940 | 605 | 0.012 | 0.080 | 8.4 | 2 |
| | B4 | 920 | 610 | 0.035 | 0.084 | 8.2 | 24 |
| | B5 | 915 | 590 | 0.012 | 0.076 | 8.6 | 3 |
| | B6 | 920 | 610 | 0.016 | 0.066 | 8.7 | 2 |
| | B7 | 890 | 580 | 0.016 | 0.042 | 9.5 | 3 |
| | B8 | 935 | 630 | 0.009 | 0.058 | 8.4 | 2 |
| | B9 | 920 | 610 | 0.011 | 0.063 | 8.5 | 3 |
| | B10 | 920 | 600 | 0.010 | 0.054 | 8.3 | 2 |
| | B11 | 910 | 620 | 0.028 | 0.062 | 8.0 | 28 |
| | B12 | 930 | 615 | 0.014 | 0.060 | 9.4 | 3 |

| | Mechanical Properties in Rolling Direction (JIS 5) | | | Punched Hole Expansion Ratio % | Conical Cut Test Value (mm) | Secondary Workability (limit drawing ratio) | Aging Property (yield point elongation after 100° C × 60 min |
|---|---|---|---|---|---|---|---|
| | Yield point (Kg/mm²) | Tensile strength (Kg/mm²) | Elongation (%) | | | | |
| A1 | 20.9 | 31.4 | 50 | 289 | 83.7 | 3.1 | 0 |
| A2 | 21.2 | 32.0 | 49 | 292 | 83.9 | 3.2 | 0 |
| A3 | 21.3 | 32.1 | 51 | 258 | 84.1 | 3.0 | 0 |
| A4 | 21.6 | 32.4 | 50 | 266 | 84.0 | 3.1 | 0 |
| A5 | 21.8 | 32.6 | 49 | 290 | 83.8 | 3.2 | 0 |
| A6 | 20.8 | 31.4 | 52 | 295 | 83.6 | 3.2 | 0 |
| A7 | 21.2 | 31.8 | 50 | 287 | 83.9 | 3.1 | 0 |
| A8 | 20.6 | 30.9 | 51 | 263 | 84.2 | 3.2 | 0 |
| A9 | 21.4 | 31.9 | 49 | 259 | 84.2 | 3.2 | 0 |
| A10 | 21.2 | 31.6 | 50 | 291 | 83.6 | 3.1 | 0 |
| A11 | 21.2 | 33.3 | 48 | 210 | 84.5 | 3.2 | 0 |
| A12 | 20.8 | 32.6 | 49 | 220 | 84.7 | 3.0 | 0 |
| A13 | 21.4 | 32.8 | 48 | 205 | 84.6 | 3.4 | 0 |
| B1 | 22.2 | 32.0 | 49 | 275 | 83.9 | 2.2 | 0.2 |
| B2 | 21.2 | 31.5 | 50 | 284 | 83.6 | 2.3 | 1.0 |
| B3 | 21.6 | 31.8 | 51 | 278 | 83.6 | 2.2 | 1.3 |
| B4 | 21.6 | 32.1 | 48 | 156 | 85.4 | 2.2 | 3.4 |
| B5 | 23.7 | 33.6 | 42 | 182 | 85.1 | 2.1 | 0.4 |
| B6 | 23.1 | 33.2 | 41 | 186 | 85.2 | 2.2 | 0.3 |
| B7 | 23.9 | 34.2 | 40 | 187 | 85.3 | 2.5 | 4.6 |
| B8 | 21.6 | 31.7 | 49 | 274 | 83.6 | 2.2 | 0.5 |
| B9 | 22.5 | 32.2 | 49 | 280 | 83.8 | 2.1 | 0.2 |
| B10 | 23.5 | 33.8 | 42 | 188 | 85.0 | 2.2 | 0.3 |
| B11 | 21.3 | 31.6 | 49 | 149 | 85.3 | 2.1 | 3.2 |
| B12 | 23.4 | 33.9 | 41 | 176 | 85.2 | 2.5 | 0.5 |

EXAMPLE 3

As shown in Table 4, the steels of the present invention were hot rolled into a 2.7mm thickness under different rolling conditions, the only difference being the total reduction between 1150° and 1050° C.

Various properties of the hot rolled steel sheets thus obtained are shown in Table 5.

As seen from Table 5, the steel $C_2$ which was given more than 40% reduction between 1150° and 1,050° C has a larger grain size and is softer than the steel $C_1$ and also has excellent cold workability.

What is claimed is:

1. A hot rolled steel sheet having excellent cold workability and ageing resistance consisting essentially of not more than 0.10% C, not more than 0.02% Si, not more than 0.50% Mn, not more than 0.008% N, 0.003 to 0.08% sol. A1, 0.0020 to 0.0050% B with the balance being Fe and unavoidable impurities, in which 2.7 [N%] ≦ (A1 + B) ≦ 20 [N%], the ratio of B/N is less than 1.0 and wherein the sheet has a grain size number not larger than No. 9 of ASTM.

2. The sheet of claim 1 in which the sol. A1 content is from 0.015 to 0.06%.

Table 4

Chemical Compositions and Hot Rolling Conditions

| | Chemical Composition (wt %) | | | | | | | | Hot Rolling Conditions | | |
|---|---|---|---|---|---|---|---|---|---|---|---|
| | C | Si | Mn | P | S | sol.Al | B | N | Finishing Temp(° C) | Coiling Temp. (° C) | Total Reduction between 1150 and 1050° C (%) |
| C1 | 0.041 | 0.012 | 0.25 | 0.017 | 0.013 | 0.024 | 0.0025 | 0.0049 | 890 | 625 | 35 |
| C2 | " | " | " | " | " | " | " | " | " | " | 52 |

Table 5

Various Properties of Steel Sheets

| | Mechanical Properties (JIS 5) | | | Punched hole expanding ratio (%) | Conical cup value (mm) | Ferrite grain size (ASTM No) | Secondary workability (limit drawing ratio | Ageing Property (YP.El after 100° C for 60 minutes) (%) |
|---|---|---|---|---|---|---|---|---|
| | Yield point (Kg/mm²) | Tensile strength (Kg/mm²) | Elongation (%) | | | | | |
| C1 | 22.3 | 33.1 | 48.2 | 120 | 84.8 | 8.5 | 3.2 | 0 |
| C2 | 19.7 | 31.8 | 49.8 | 130 | 84.5 | 8.0 | 3.2 | 0 |

3. The sheet of claim 1 in which the manganese content is not more than 0.25%.

4. The sheet of claim 1 which further contains one or more elements selected from the group consisting of Zr, Ca, Mg and REM elements in an amount between 0.01 and 0.20% in single or in total.

5. The sheet of claim 1 in which the carbon content is less than 0.010%.

6. The steel sheet of claim 1 wherein acid soluble aluminum is present in an amount sufficient to kill the steel.

7. The sheet of claim 1 which further contains one or more elements selected from the group consisting of Zr, Ca, Mg and REM elements in an amount of 0.01 to 0.20% in single or in total and one or more elements selected from the group consisting of Ti, Cr, V, Nb, Mo and W in an amount of 0.01 to 0.10% in single or in total.

8. The sheet of claim 1 in which the manganese is not more than 0.25% and less than 0.010% S is present.

9. In a method for producing sheet of claim 1 wherein a slab is prepared by conventional methods and the slab is hot rolled, the improvement which comprises hot rolling the slab at a finishing temperature not lower than the $Ar_3$ temperature and coiling the sheet at coiling temperature not higher than 680° C so as to avoid coarsening of carbides.

10. The method according to claim 9 in which the slab is rolled at a temperature between 1150° and 1050° and the total reduction in that temperature range is at least 40% on the basis of the plate thickness at 1150° C.

* * * * *